US008328531B2

(12) United States Patent
Milliff et al.

(10) Patent No.: US 8,328,531 B2
(45) Date of Patent: Dec. 11, 2012

(54) SCROLL COMPRESSOR WITH THREE-STEP CAPACITY CONTROL

(75) Inventors: Tracy L. Milliff, Arkadelphia, AR (US); Zili Sun, Arkadelphia, AR (US); Tapesh P. Patel, Hotsprings, AR (US); Jacob Munich, Saddlebrooke, AZ (US); Joe T. Hill, Arkadelphia, AR (US); Gene Fields, Arkadelphia, AR (US)

(73) Assignee: Danfoss Scroll Technologies, LLC, Arkadelphia, AR (US)

( * ) Notice: Subject to any disclaimer, the term of this patent is extended or adjusted under 35 U.S.C. 154(b) by 578 days.

(21) Appl. No.: 12/357,580

(22) Filed: Jan. 22, 2009

(65) Prior Publication Data

US 2010/0183453 A1 Jul. 22, 2010

(51) Int. Cl.
*F04B 49/00* (2006.01)
*F04B 17/00* (2006.01)
*F04B 35/04* (2006.01)

(52) U.S. Cl. ..... 417/310; 417/410.5; 137/625.48

(58) Field of Classification Search ..... 417/308, 417/310, 410.5, 440; 137/625.64, 625.65, 137/625.48

See application file for complete search history.

(56) References Cited

U.S. PATENT DOCUMENTS

| | | | | |
|---|---|---|---|---|
| 4,382,370 | A * | 5/1983 | Suefuji et al. | 62/324.1 |
| 4,383,805 | A * | 5/1983 | Teegarden et al. | 417/308 |
| 4,431,388 | A * | 2/1984 | Eber et al. | 418/55.1 |
| 4,456,435 | A * | 6/1984 | Hiraga et al. | 417/302 |
| 4,497,615 | A * | 2/1985 | Griffith | 417/310 |
| 4,508,491 | A | 4/1985 | Schaefer | |
| 4,846,633 | A * | 7/1989 | Suzuki et al. | 417/310 |
| 5,336,058 | A * | 8/1994 | Yokoyama | 417/299 |
| 5,551,846 | A | 9/1996 | Taylor et al. | |
| 6,413,058 | B1 | 7/2002 | Williams | |
| 6,478,550 | B2 * | 11/2002 | Matsuba et al. | 417/310 |
| 7,513,753 | B2 * | 4/2009 | Shin et al. | 417/310 |
| 2009/0028723 | A1 * | 1/2009 | Wallis et al. | 417/295 |

FOREIGN PATENT DOCUMENTS

| | | |
|---|---|---|
| DE | 19517748 | 11/1995 |
| EP | 1004773 | 5/2000 |
| EP | 1101943 | 5/2001 |
| EP | 1686265 | 8/2006 |
| JP | 60075796 | 4/1985 |

OTHER PUBLICATIONS

European Search Report dated Jun. 28, 2010.

* cited by examiner

*Primary Examiner* — Devon Kramer
*Assistant Examiner* — Peter J Bertheaud
(74) *Attorney, Agent, or Firm* — Carlson, Gaskey & Olds, PC

(57) ABSTRACT

A scroll compressor comprises a first scroll member having a generally spiral wrap and a second scroll member having a generally spiral wrap. The generally spiral wraps interfit to define compression chambers. A pair of ports leads from the compression chambers. A pair of valves selectively blocks flow of refrigerant from the ports leaving the compression chambers. The valves selectively control the flow such that flow may pass from neither of the two ports, from both of the two ports, or from only one of the two ports to provide three levels of capacity control.

3 Claims, 5 Drawing Sheets

SCROLL COMPRESSOR WITH THREE-STEP CAPACITY CONTROL

BACKGROUND OF THE INVENTION

This application relates to a scroll compressor having capacity control valving.

Scroll compressors are becoming widely utilized in refrigerant compression applications. In a typical scroll compressor, a first generally spiral scroll wrap interfits with a second generally spiral scroll wrap. The interfitting wraps define compression chambers that entrap and compress a refrigerant.

Under various conditions in refrigerant compression applications, it may be desirable to reduce the capacity, or amount of refrigerant that is being compressed. As an example, should the load on an air conditioning system drop, then it would be energy efficient to reduce the amount of refrigerant compressed. Various types of capacity control are known. In one standard capacity control, valves open ports that communicate the compression chambers back to a suction chamber in the scroll compressor. When the valves are open, the refrigerant flows back to the suction chamber, and the amount of refrigerant that is fully compressed is reduced, thereby reducing the capacity, and the energy used by the compressor.

Various capacity control arrangements are known and have been used, however, in general, they have not provided as much flexibility as would be desirable.

SUMMARY OF THE INVENTION

In a disclosed embodiment of this invention, a scroll compressor is provided with three steps of capacity control.

These and other features of the present invention can be best understood from the following specification and drawings, the following of which is a brief description.

DETAILED DESCRIPTION OF THE PREFERRED EMBODIMENT

Figure 1:
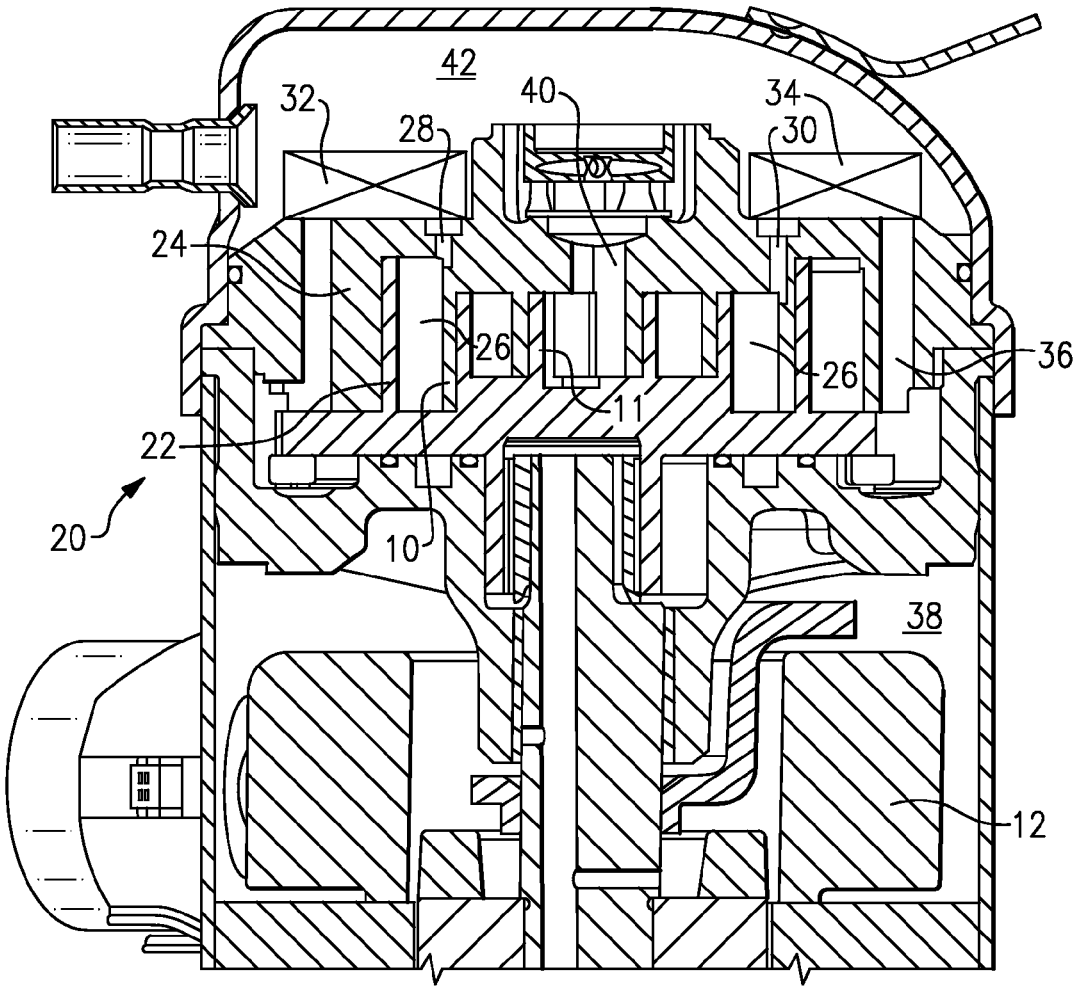
FIG. 1 schematically shows a scroll compressor.

A scroll compressor 20 as illustrated in FIG. 1 includes an orbiting scroll member 22 interfitting with a non-orbiting scroll member 24. Compression chambers 26 are defined between the scroll members 22 and 24. As shown in this Figure, the wrap on the scroll members includes a first outer higher portion 10 and an inner lower portion 11. Such two-step scroll compressors are known, and are disclosed for example in co-pending patent application Ser. No. 11/833,342, entitled Stepped Scroll Compressor With Staged Capacity Modulation.

The compression chambers 26 are shown communicating with ports 28 and 30. Valves 32 and 36 are shown schematically, and can selectively communicate the ports 28 and 30 back to a suction pressure chamber 38 through passages 36. Typically, when operating at full capacity, the orbiting scroll member 28 is driven to orbit by a motor 12, and compresses the refrigerant in the compression chambers 26 toward a discharge port 40. Refrigerant compressed through the discharge port 40 passes into a discharge pressure chamber 42, and then to a downstream use. However, when less capacity is necessary, one or both of the valves 32 and 34 may be opened to reduce the provided capacity. In this manner, three steps of capacity can be provided, e.g., 100%, 70%, and 45% of capacity.

Figure 2:
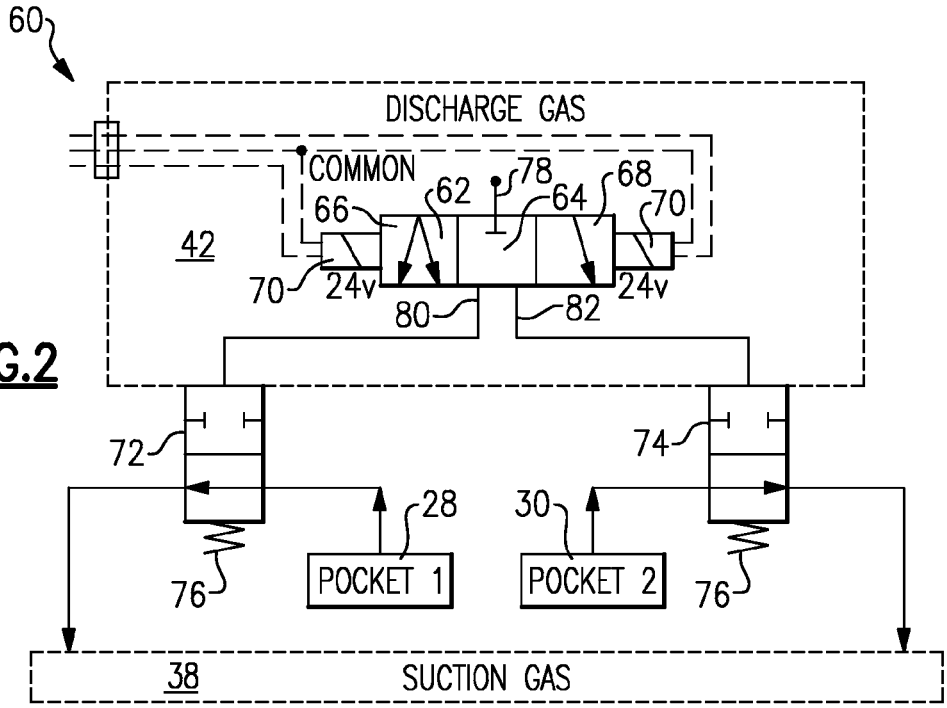
FIG. 2 is a flow schematic of a first embodiment of this invention.

FIG. 2 shows a first schematic 60 wherein a single solenoid valve 62 includes a blocking portion 64, a portion 66, and another portion 68. A source of pressurized gas 78, which may be from the discharge pressure chamber 42, communicates to the valve 62. Voltage is selectively applied to solenoid 70 to properly position the valve 62. In the illustrated position, the source of pressurized gas 72 does not communicate to either line 80 or 82. Lines 80 and 82 provide pressurized fluid to valves 72 and 74. The valves 72 and 74 are typically moved by a spring to a position allowing the flow of refrigerant from the pockets 28 and 30 back to the suction chamber 38. Of course, the valves 72 and 74 can be normally positioned such that they block flow.

When full capacity is desired, then the valve 62 is moved to the position such that the source 78 is aligned with the portion 66. Pressurized refrigerant now flows to both lines 80 and 82, and both valves 72 and 74 are biased to the closed position. When a first step of reduced capacity is desired, the valve is moved such that portion 68 aligns with source 78. In that position, pressurized refrigerant is sent through the passage 82, and the valve 74 is biased to a closed position with the valve 72 remaining open. Now, an intermediate reduced capacity is achieved. Again, when even less capacity is desired, the valve 60 is moved back to the illustrated position such that pressurized fluid does not flow to valve 72 or 74.

Figure 3:
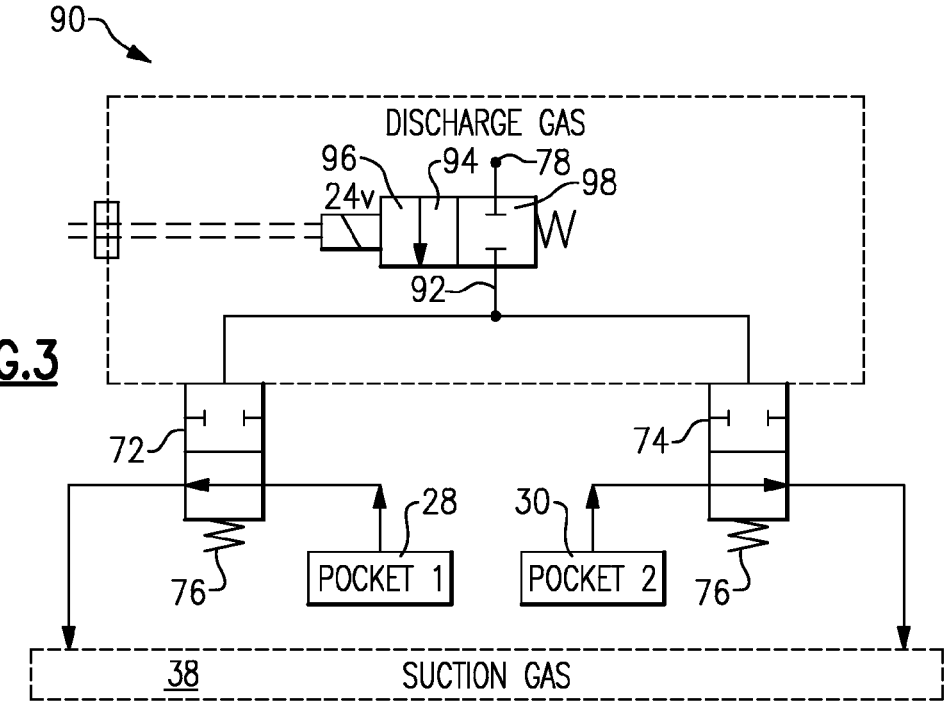
FIG. 3 shows a second embodiment.

FIG. 3 shows another embodiment 90 wherein the basic arrangement of FIG. 2 is maintained, however, only two steps of capacity control are used. In this embodiment, the valve 94 has portions 96 and 98. When in the illustrated position, biased by a spring, the source of pressurized gas 78 does not communicate to the line 92. Both valves are maintained in their open position and a reduced capacity is achieved. On the other hand, when full capacity is desired, the valve is moved such that portion 96 aligns with the source 78, and both valves 72 and 74 are moved to block the reduction of capacity.

Figure 4:
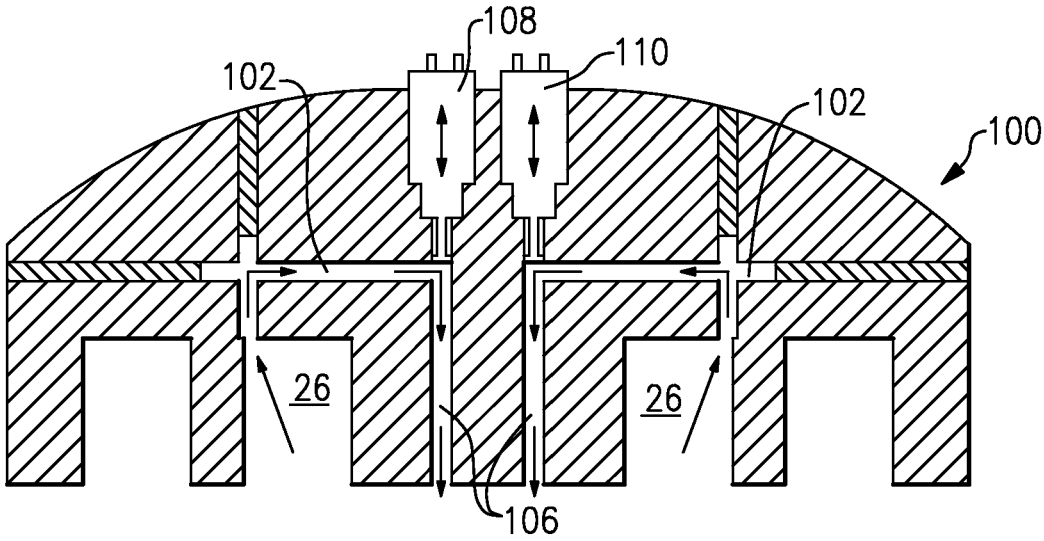
FIG. 4 shows a third embodiment.

FIG. 4 shows yet another embodiment 100 wherein passages 102 selectively communicate to central passages 106 leading back to a suction pressure area in the scroll compressor. Additional passages may be necessary to fully communicate portion 106 to a suction portion. Valves 108 and 110 may be solenoid valves, and may be left in the illustrated position to reduce capacity. When full capacity is desired, the valves are moved to block flow from the passage 102 reaching the passage 106. In addition, only one of the two valves may be opened to provide an intermediate capacity reduction.

Figure 5:
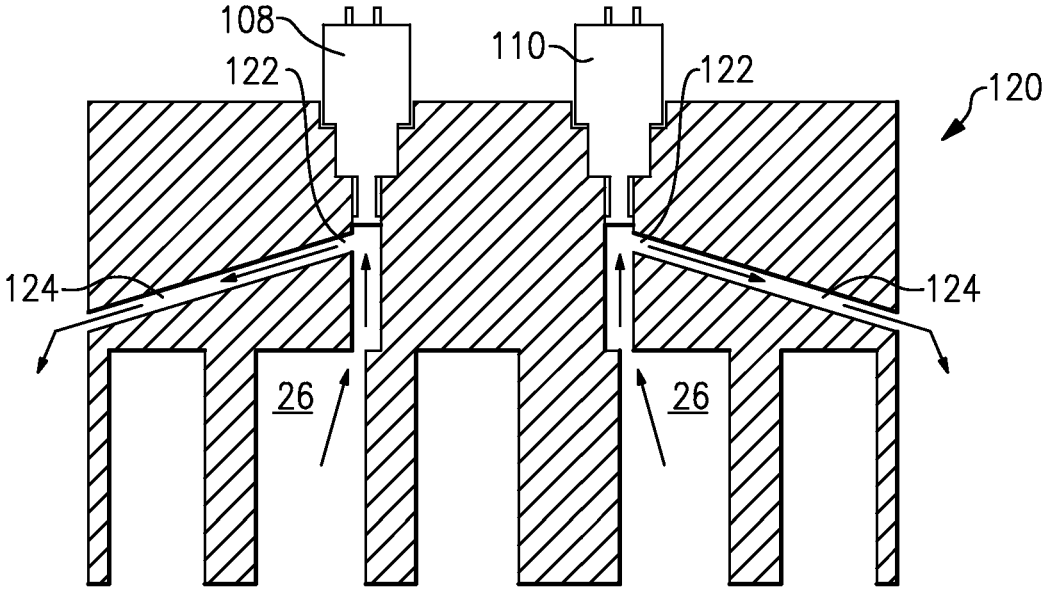
FIG. 5 shows yet another embodiment.

FIG. 5 shows yet another embodiment 120 wherein the valves 108 and 110 block flow from a point 122 from reaching a passage 124 leading back to the suction pressure chamber. Again, three steps of capacity can be provided by the FIG. 5 embodiment by either blocking both passages 122, allowing flow through both, or blocking only one.

Figure 6:
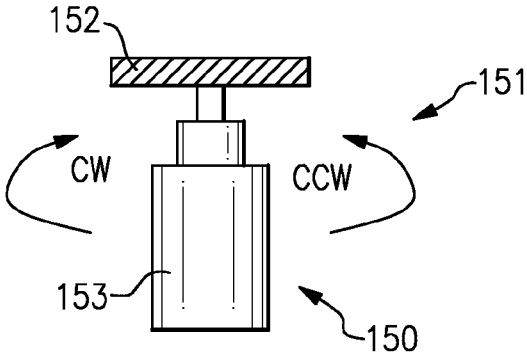
FIG. 6 shows another embodiment.
Figure 7:
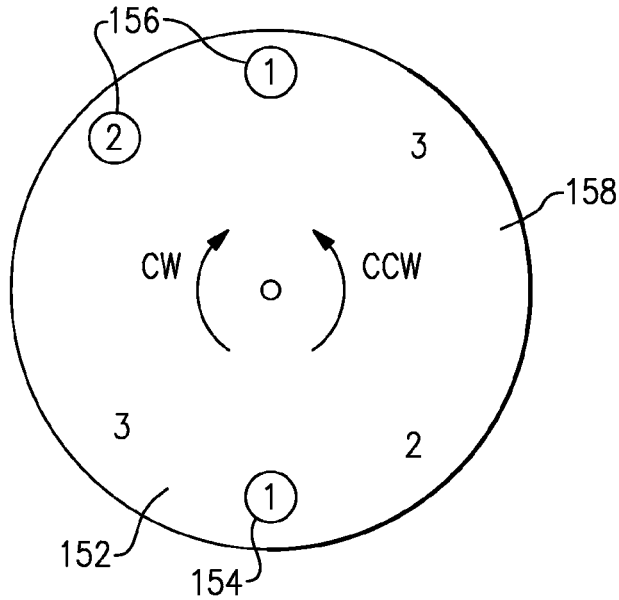
FIG. 7 shows another feature of the FIG. 6 embodiment.

FIG. 6 shows an embodiment 151 wherein a rotary plate 152 is driven by a motor 153. As shown in FIG. 7, the plate 152 has a first position 154 wherein one of the two passages such as shown in the prior embodiments is allowed to dump to the suction chamber. A second position 156 aligns both passages with the suction chamber. A third position 155 will block flow from both passages.

Figure 8:
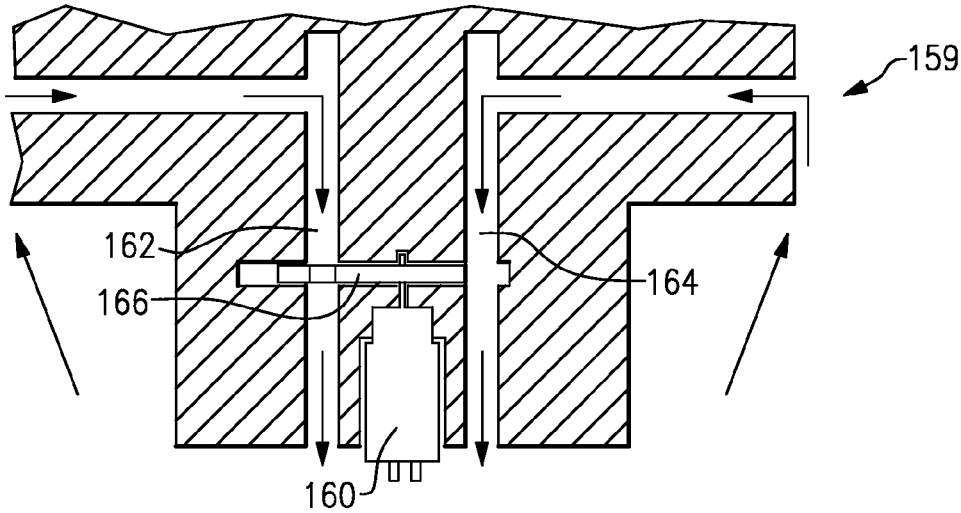
FIG. 8 shows another embodiment.

FIG. 8 shows yet another embodiment 159 wherein a rotary motor 160 has a rotary to linear connection of some sort that drives an elongate rod 166 to either block or allow flow from the passages 162 and 164.

Figure 9A:
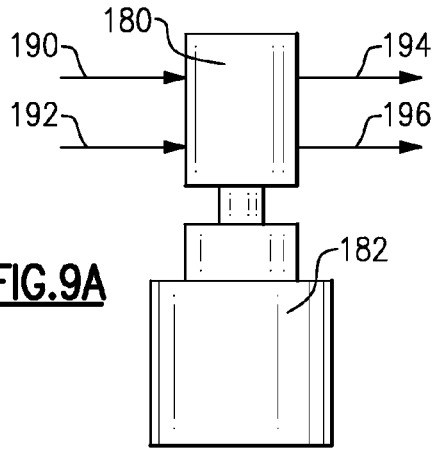
FIG. 9A shows yet another embodiment.
Figure 9B:
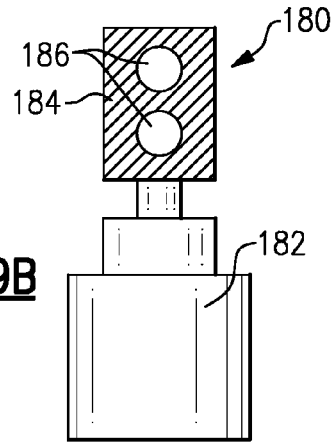
FIG. 9B shows another portion of the FIG. 9A embodiment.

FIG. 9A shows another embodiment wherein a motor 182 drives a rotary valve 180. The rotary valve 180 selectively communicates the two passages 190 and 192 communicating with the compression chambers to dump passages 194 and 196 leading back to suction. As shown in FIG. 9B, in one position of the valve 180, a head 184 includes two passages 186. When these passages are aligned with the passages 190 and 192, then flow is dumped from both passages, and a greatest amount of capacity reduction is achieved.

Figure 9C:
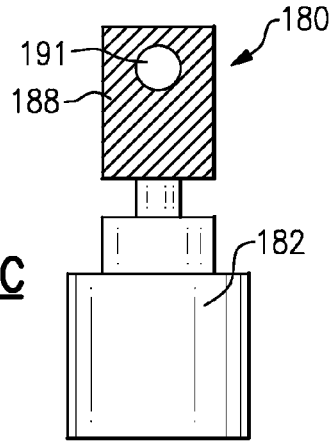
FIG. 9C shows another portion of the FIG. 9A embodiment.

FIG. 9C shows the head 180 in another position 184 wherein only one passage 191 communicates with the passage 190. This will provide an intermediate amount of capacity reduction.

Figure 9D:
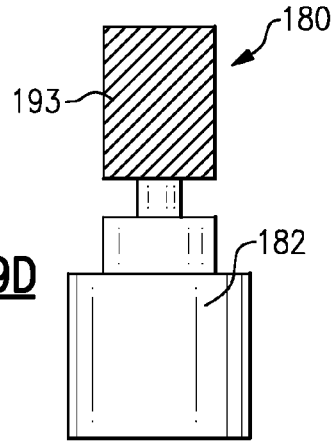
FIG. 9D shows yet another portion of the FIG. 9A embodiment.

FIG. 9D shows another position 193 wherein flow from both passages 190 and 192 will be blocked.

Figure 10:
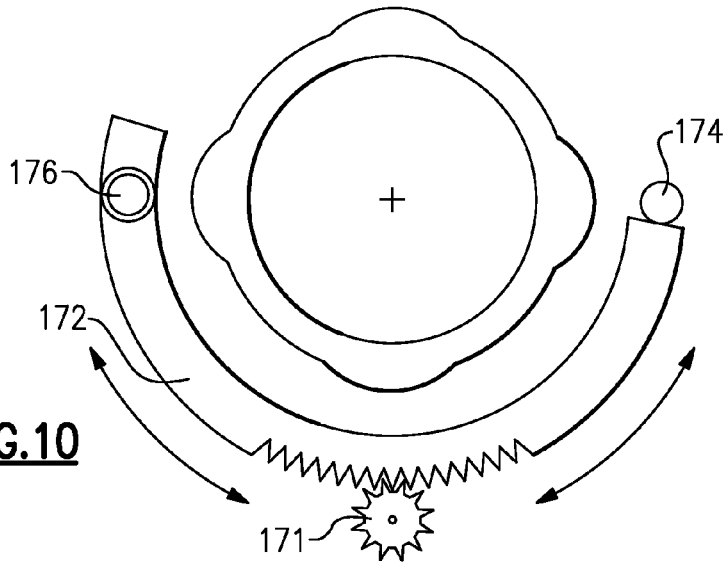
FIG. 10 shows yet another embodiment.

FIG. 10 shows yet another embodiment 170 wherein a rotary gear 171 rotates rack teeth on a ring 172. Ports 174 and 176 can be selectively opened or closed by properly rotating the rack 172.

Several embodiments of this invention have been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a spiral wrap;

a second scroll member having a spiral wrap, said spiral wraps interfitting to define compression chambers;

a pair of ports leading from said compression chambers;

a pair of valves for selectively blocking flow from said ports leaving said compression chambers;

the pair of valves being controllable such that flow may pass from neither of the two ports, from both of the two ports, or from only one of the two ports; and wherein said pair of valves are controlled by a fluid, a single three-position solenoid valve controls the flow of the fluid to each of said valves, said single three-position solenoid valve being axially movable to said three positions to selectively provide a compressed refrigerant to each of said valves to selectively block or allow flow from the ports, such that said single three-position solenoid valve can be in a first position such that fluid may pass from neither of the two ports, a second position where fluid may pass from both of the two ports, and a third position where fluid may pass from only one of the two ports, thereby providing three levels of capacity.

2. A scroll compressor comprising:

a first scroll member having a spiral wrap;

a second scroll member having a spiral wrap, said spiral wraps interfitting to define compression chambers;

a pair of ports leading from said compression chambers;

a pair of valves for selectively blocking flow of refrigerant from said ports leaving said compression chambers, said valves being controlled by a fluid;

a single three-position solenoid valve to control the flow of the fluid to the valves; and wherein said single three-position solenoid valve controls the flow of the fluid to each of said valves, said single three-position solenoid valve being axially movable to said three positions to selectively provide a compressed refrigerant to each of said valves to selectively block or allow flow from the ports, such that said single three-position solenoid valve can be in a first position such that fluid may pass from neither of the two ports, a second position where fluid may pass from both of the two ports, and a third position where fluid may pass from only one of the two ports, thereby providing three levels of capacity.

3. A method of operating a scroll compressor including the steps of:

providing a pair of ports leading from compression chambers;

controlling the flow from said ports leaving said compression chambers with a pair of valves, such that flow may pass from neither of the two ports, from both of the two ports, or from only one of the two ports;

controlling said pair of valves with a fluid; and providing a single three-position solenoid valve for controlling the flow of the fluid to each of said valves, said single three-position solenoid valve being axially movable to said three positions to selectively provide a compressed refrigerant to each of said valves to selectively block or allow flow from the ports, such that said single three-position solenoid valve can be in a first position such that fluid may pass from neither of the two ports, a second position where fluid may pass from both of the two ports, and a third position where fluid may pass from only one of the two ports, thereby providing three levels of capacity.

* * * * *